US006486762B2

(12) United States Patent
Kurasawa et al.

(10) Patent No.: US 6,486,762 B2
(45) Date of Patent: Nov. 26, 2002

(54) MAGNETIC SWITCH FOR STARTER MOTOR

(75) Inventors: Tadahiro Kurasawa, Chita-gun (JP); Kazuhiro Andoh, Okazaki (JP); Yasuyuki Wakahara, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/977,390

(22) Filed: Oct. 16, 2001

(65) Prior Publication Data

US 2002/0067231 A1 Jun. 6, 2002

(30) Foreign Application Priority Data

Dec. 1, 2000 (JP) ..... 2000-367474

(51) Int. Cl.[7] ..... H01H 67/02
(52) U.S. Cl. ..... 335/278; 335/202; 335/281
(58) Field of Search ..... 335/106, 127–132, 335/202, 278, 281

(56) References Cited

U.S. PATENT DOCUMENTS 4,243,964 A 1/1981 Bögner et al.
4,251,788 A * 2/1981 Barthruff et al. ..... 335/131
5,256,992 A 10/1993 Fasola et al.
5,383,428 A * 1/1995 Fasola et al. ..... 123/179.3

* cited by examiner

*Primary Examiner*—Ramon M. Barrera
(74) *Attorney, Agent, or Firm*—Law Offices of David G. Posz

(57) ABSTRACT

In a magnetic switch for a starter motor, a magnetic core member providing a magnetic flux path is composed of separate components: a first core, a cylindrical yoke and a second core, all contained in a cup-shaped frame in close contact to one another. The first core is forcibly inserted into the cup-shaped frame, and the cylindrical yoke formed by rounding a flat plate into a C-shaped body having a small opening is also forcibly inserted in the cup-shaped frame by squeezing the small opening. The separate components are firmly pressed to each other by an axial force generated by caulking an open end of the cup-shaped frame. A switch cover is connected to the magnetic core member not to loosen the axial force connecting the components. Thus, magnetic resistance increase in the magnetic flux path formed by separate components is effectively suppressed.

6 Claims, 4 Drawing Sheets

MAGNETIC SWITCH FOR STARTER MOTOR

CROSS-REFERENCE TO RELATED APPLICATION

This application is based upon and claims benefit of priority of Japanese Patent Application No. 2000-367474 filed on Dec. 1, 2000, the content of which is incorporated herein by reference.

BACKGROUND OF THE INVENTION

1. Field of the Invention

The present invention relates to a magnetic switch of a starter motor for cranking an internal combustion engine.

2. Description of Related Art

A frame of a magnetic switch is usually formed by cold-forging or pressing an iron material into a rough shape and then machining some portions into exact dimensions for holding inner parts therein. When the frame is integrally formed in this manner, magnetic resistance in a magnetic flux path can be made small. However, a costly machining process is required in this method. On the other hand, there is another method of forming the frame, in which the costly machining process of the frame is eliminated and separate parts constituting a magnetic flux path are assembled. When this method is employed, however, there is a problem that a magnetic resistance in the magnetic flux path becomes high. This is because the magnetic resistance at contacting surfaces of separate parts becomes high. If the magnetic resistance in the magnetic flux path is high, a high performance of the magnetic switch cannot be attained.

SUMMARY OF THE INVENTION

The present invention has been made in view of the above-mentioned problem, and an object of the present invention is to provide an improved magnetic switch of a starter motor, employing an assembled frame structure in which the magnetic resistance in the magnetic flux path is suppressed.

A magnetic switch is used for closing or opening an electrical circuit for supplying electrical power to a starter motor. The magnetic switch includes a pair of stationary contacts, a movable contact for closing or opening the stationary contacts, and an electromagnetic actuator for driving the movable contact. The electromagnetic actuator includes a coil for generating a magnetic flux, a magnetic core member for providing a magnetic flux path for the coil, and a plunger for driving the movable contact upon energization of the coil. A switch cover forming a switch chamber in which the pair of stationary contacts and the movable contact are disposed is connected to the magnetic core member.

The magnetic core member is composed of a first core, a cylindrical yoke and a second core. All the components of the magnetic core member are contained together in a cup-shaped frame by peening an open end of the cup-shaped frame, so that they firmly contact one another not to increase the magnetic resistance in the magnetic flux path. The cup-shaped frame has a bottom wall and a cylindrical portion, and a squeezed portion having a smaller diameter is formed in the cylindrical portion next to the bottom wall. The disc-shaped first core is forcibly inserted in the squeezed portion of the frame.

The cylindrical yoke is made by rounding a flat plate into a C-shaped body having a small opening and an outer diameter a little larger than an inner diameter of the cylindrical portion of the frame. The C-shaped body is forcibly inserted into the cylindrical portion by squeezing the small opening. The second core is also inserted in the cylindrical portion of the frame. Components forming the magnetic core member are all pressed together by an axial force generated by peening an outer periphery of the cylindrical portion of the frame.

The switch cover is pushed against the magnetic core member and connected thereto by peening the open end of the frame. The axial force pushing the switch cover against the magnetic core member is set to a lower level than the axial force connecting together the components of the magnetic core member, so that the close contact of the components is not loosened by pressing the switch cover toward the magnetic core member. The thickness of the disc-shaped first core is made smaller the depth of the squeezed portion of the frame to secure a close contact between the first core and the cylindrical yoke.

The switch cover is pushed against the magnetic core member and connected thereto by caulking the open end of the frame. The axial force pushing the switch cover against the magnetic core member is set to a lower level than the axial force connecting together the components of the magnetic core member, so that the close contact of the components is not loosened by pressing the switch cover toward the magnetic core member. The thickness of the disc-shaped first core is made smaller the depth of the squeezed portion of the frame to secure a close contact between the first core and the cylindrical yoke.

According to the present invention, increase of the magnetic resistance in the magnetic flux path is minimized, though the magnetic core member forming the magnetic flux path is composed of separate components.

Other objects and features of the present invention will become more readily apparent from a better understanding of the preferred embodiments described below with reference to the following drawings.

DETAILED DESCRIPTION OF THE PREFERRED EMBODIMENTS

Figure 1:
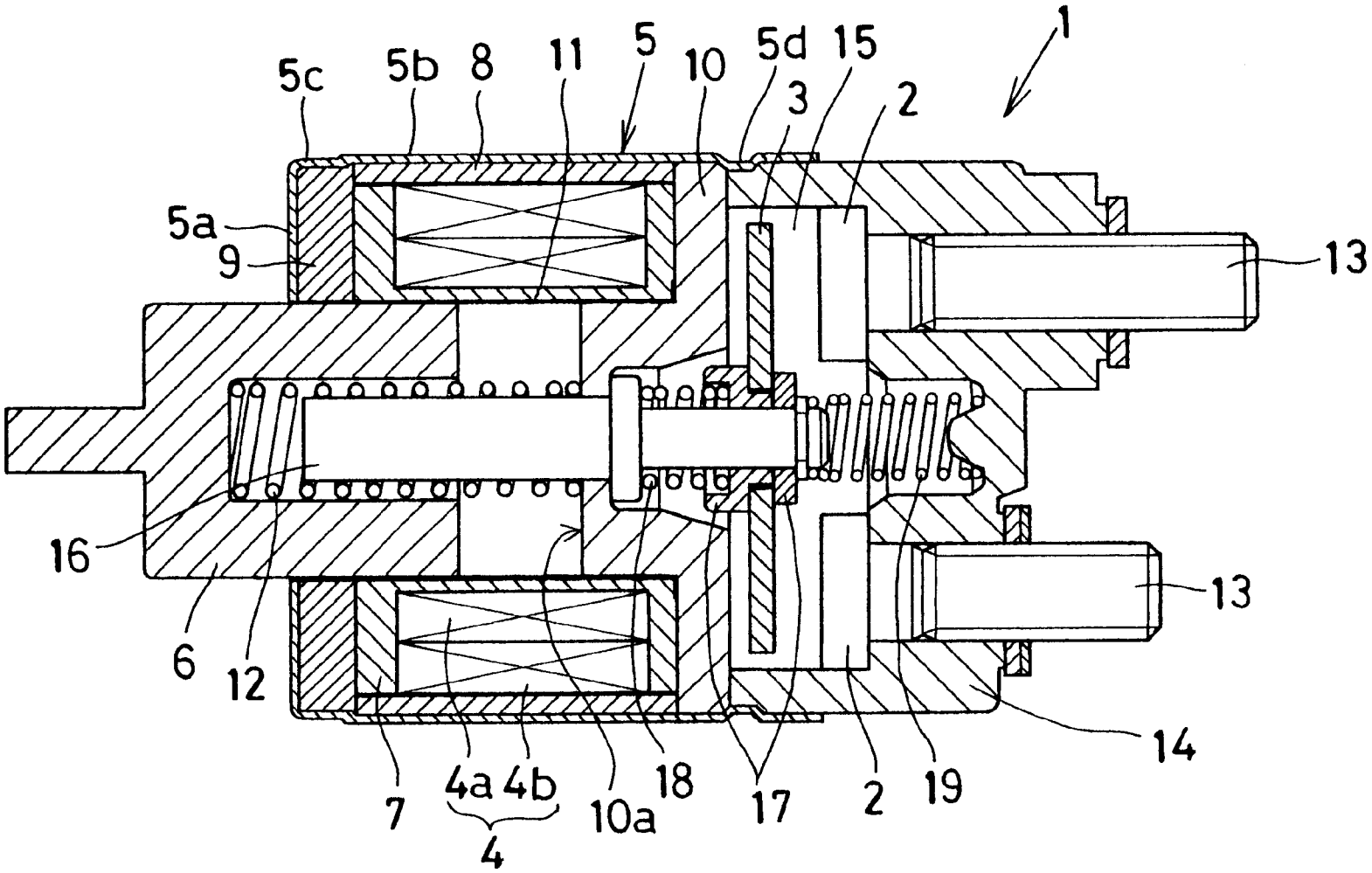
FIG. 1 is a cross-sectional view showing an entire structure of a magnetic switch as a first embodiment of the present invention.

A first embodiment of the present invention will be described with reference to FIGS. 1 and 2. As shown in FIG. 1, a magnetic switch 1 includes a pair of stationary contacts 2, a movable contact 3 and an electromagnetic actuator for driving the movable contact 3. The pair of stationary contacts 2 are closed with the movable contact 3 when the movable contact 3 is driven rightward (in FIG. 1).

The electromagnetic actuator is composed of a coil 4 generating a magnetic flux when energized, a magnetic core member disposed around the coil 4 to provide a magnetic flux path for the coil 4, a frame 5 containing the magnetic core member therein and constituting a part of the magnetic flux path, a plunger 6, and other associated parts. The coil 4 composed of a pull-in coil 4*a* and a holding coil 4*b* is wound around a bobbin 7.

The magnetic core member is composed of a cylindrical yoke 8 disposed around the coil 4, a first core 9 disposed at one end of the yoke 8 and a second core 10 disposed at the other end of the yoke 8. Those components constituting the magnetic core member are all made of a magnetic material such as iron and contained in the frame 5 together. The second core 10 includes a boss portion inserted into an inner bore of the bobbin 7, and the boss portion has a stopper surface 10*a* with which the plunger 6 abuts when it is driven rightward upon energization of the coil 4.

The frame 5 is formed by drawing a steel plate into a cup-shape. It includes a bottom wall 5*a*, a cylindrical portion 5*b* and an opening at an opposite side of the bottom wall 5*a*. A squeezed portion 5*c* having an inner diameter a little smaller than that of the cylindrical portion 5*b* is formed at the bottom wall side. The first core 9 having an outer diameter a little larger than the inner diameter of the squeezed portion 5*c* is press-fitted in the squeezed portion 5*c*. The yoke 8 and the second core 10 are also disposed in the frame 5 as shown in FIG. 1.

A cylindrical sleeve 11 is disposed in the inner bore of the bobbin 7, and the plunger 6 is slidably supported in the inner bore of the bobbin 7 via the cylindrical sleeve 11. The plunger 6 is biased leftward by a return spring 12 disposed between the plunger 6 and the stopper surface 10*a* of the second core 10. A switch cover 14 carrying a pair of terminals 13 is connected to the magnetic core member by peening the frame 5. One of the pair of terminals 13 is electrically connected to an on-board battery (not shown), and the other terminal 13 is electrically connected to a field coil of a starter motor (not shown). A switch chamber 15 in which the movable contact 3 and the stationary contacts 2 are disposed is formed between the second core 10 and the switch cover 14.

The movable contact 3 is slidably mounted on an intermediate rod 16 via a pair of resin members 17 and is biased rightward (in FIG. 1) by a contact spring 18. The intermediate rod 16 is slidably supported by the boss of the second core 10 through the stopper surface 10*a* and is biased leftward by a spring 19 held between the intermediate rod 16 and the switch cover 14. When the plunger 6 moves rightward upon energization of the coil 4, the left end of the intermediate rod 16 abuts the plunger 6 and the intermediate rod 16 moves rightward together with the plunger 16, thereby closing the pair of stationary contacts 2 with the movable contact 3.

Figure 2:
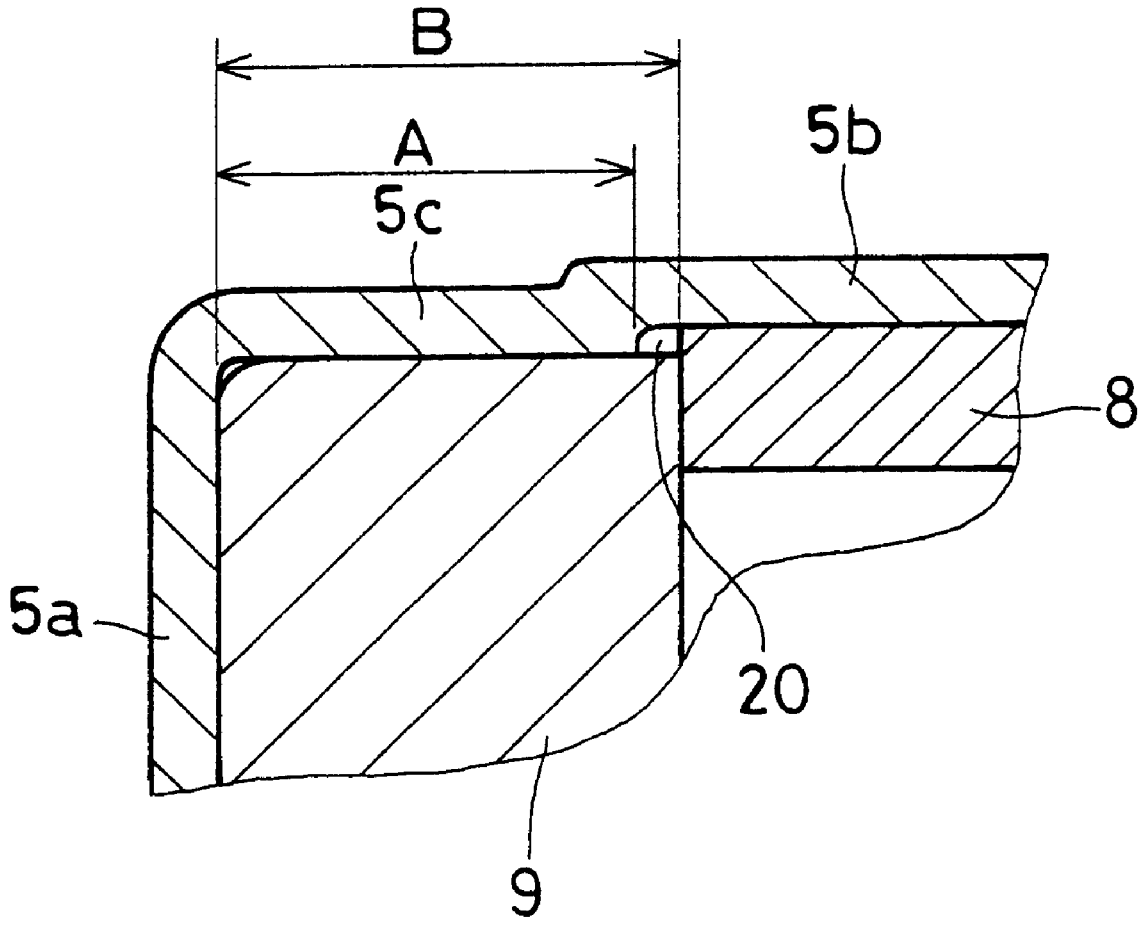
FIG. 2 is a cross-sectional view showing a structure of a magnetic core member in detail in an enlarged scale.

Referring to FIG. 2 together with FIG. 1, the assembling structure of the magnetic core member (composed of the first core 9, the yoke 8 and the second core 10) and the switch cover 14 will be described in detail. The first core 9 is press-fitted in the squeezed portion 5*c* of the frame 5. The outer diameter of the first core 9 is made a little larger than the inner diameter of the squeezed portion 5*c*. The depth "A" of the squeezed portion 5*c* is made smaller than the thickness "B" of the first core 9, so that a hollow space 20 is formed between the first core 9 and the yoke 8, as shown in FIG. 2. The first core 9, the yoke 8 and the second core 10 are assembled to push against one another by peening an outer periphery of the frame 5 at a position close to the open end thereof, thereby forming a peened portion 5*d*.

The yoke 8 is formed by rounding a rectangular flat plate into a C-shape. The C-shaped yoke 8 having a small open gap is squeeze into the inner bore of the cylindrical portion 5*b* of the frame 5, thereby closing the open gap. The outer diameter of the C-shaped yoke 8 is made a little larger than the inner bore of the cylindrical portion 5*b*, and the C-shaped yoke 8 is forcibly inserted into the cylindrical portion 5*b*.

The switch cover 14 is pushed against the second core 10 and assembled thereto by peening the open end of the frame 5. The axial force pushing the switch cover 14 against the second core 10 is set to a level lower than the axial force connecting the components of the magnetic core member (the first core 9, the yoke 8 and the second core 10). In this manner, the axial force connecting the components of the magnetic core member generated by the peening portion 5*d* is not decreased by assembling the switch cover 14 to the magnetic core member.

Operation of the magnetic switch 1 will be briefly described. Upon energization of the coil 4, the plunger 6 is pulled-in toward the stopper surface 10*a* of the second core 10 against the biasing force of the return spring 12. In the course of the plunger movement, the intermediate rod 16 abuts the plunger 6, and thereby the intermediate rod 16 moves rightward together with the plunger 6. The movable contact 3 carried by the intermediate rod 16 closes the pair of stationary contacts 2, and thereby electrical power is supplied to the starter motor. Upon de-energization of the coil 4, the plunger 6 returns to its original position by the biasing force of the return spring 12. The intermediate rod 16 also returns to its original position by the biasing force of the spring 19, thereby opening the pair of stationary contacts 2.

Advantages of the first embodiment described above are summarized as follows. Since the first core 9 is forcibly inserted into the squeezed portion 5*c* of the frame 5, the outer diameter of the first core 9 firmly contacts the inner bore of the squeezed portion 5*c*. Since the thickness "B" of the first core 9 is larger than the depth "A" of the squeezed portion 5*c*, the first core 9 partly sticks out from the squeezed portion 5*c*. Accordingly, the yoke 8 firmly contacts the surface of the first core 9 and is disposed in the cylindrical portion 5*b* of the frame 5 in firm contact therewith.

Since the C-shaped yoke 8 having a small gap is forcibly inserted in the cylindrical portion 5*b* by squeezing the small gap, the outer periphery of the yoke 8 firmly contacts the inner bore of the cylindrical portion 5*b*. Since the second core 10 is assembled by pushing the yoke 8 in the axial direction and by peening the portion 5*d*, all the components of the magnetic core member (the first core 9, the yoke 8 and the second core 10) are assembled in close contact with one another.

Since the yoke 8 is in close contact with the cylindrical portion 5*b* and the first and second cores are pushed against the yoke 8 in the axial direction, there exist high frictional forces between the cylindrical portion 5*b* and the yoke and among the components constituting the magnetic core member. Accordingly, the magnetic core member is prevented from being rotated relative to the frame 5 when a high external vibration force is imposed on the magnetic switch 1. Further, since the switch cover 14 is assembled to the magnetic core member not to exert an axial force exceeding the axial force connecting the components of the magnetic core member, which is generated by the peened portion 5*d*, the axial force connecting the components is not decreased by assembling the switch cover 14.

In summary, though the magnet core member is composed of separate components, the first core 9, the yoke 8 and the second core 10, the magnetic resistance increase in the magnetic flux path is minimized, and an adverse influence on the function of the magnetic switch 1 due to decrease of an amount of the magnetic flux is suppressed.

Figure 3:
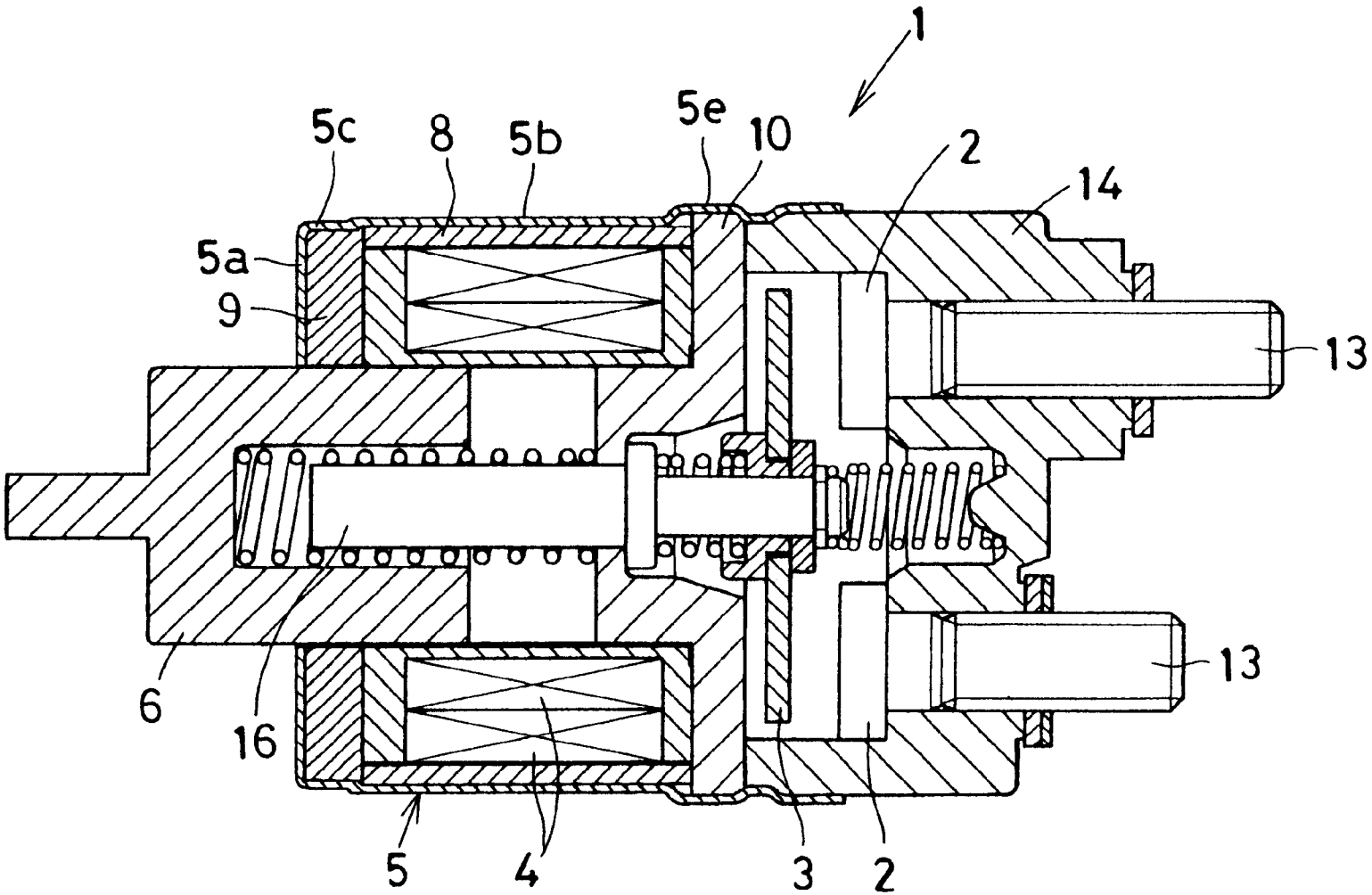
FIG. 3 is a cross-sectional view showing an entire structure of a magnetic switch as a second embodiment of the present invention.

A magnetic switch 1 as a second embodiment of the present invention is shown in FIG. 3. The second embodiment is the same as the first embodiment, except that a holding portion 5*e* for firmly fixing the second core 10 therein is formed in the cylindrical portion 5*b* of the frame 5. Since the outer periphery of the second core 10 is held in the frame 5 in close contact therewith, the magnetic resistance between the frame 5 and the second core 10 is further decreased.

Figure 4A:
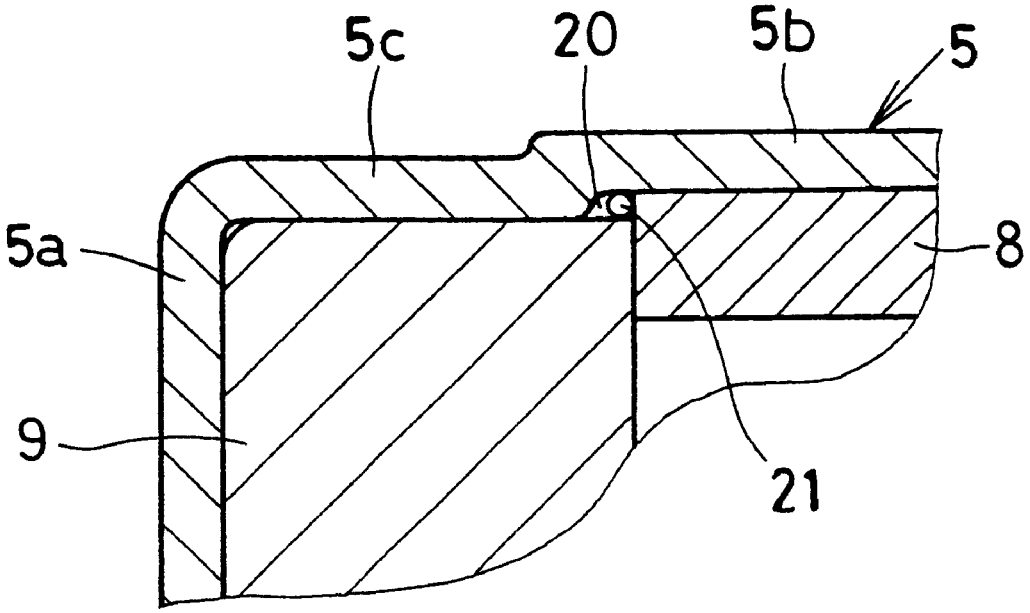
FIGS. 4A and 4B are cross-sectional views showing modified forms of the present invention.
Figure 4B:
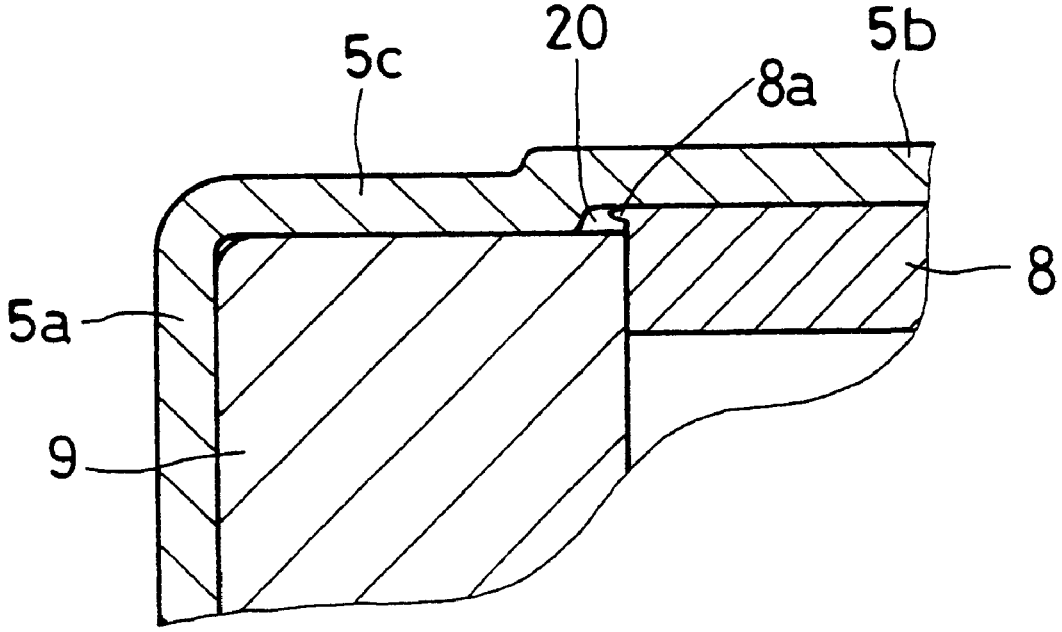

As shown in FIG. 4A, an O-ring 21 may be disposed in the hollow space 20 formed between the first core 9 and the yoke 8. The O-ring 21 serves as a member for preventing outside water from entering into the inner space of the magnetic switch 1. As shown in FIG. 4B, burrs 8*a* formed by presswork at the end of the yoke 8 are disposed in the hollow space 20. In this manner, a process for removing the burrs 8*a* can be eliminated.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A magnetic switch for a starter motor, comprising:

a coil for generating magnetic flux upon energization thereof;

a magnetic core member disposed around the coil for providing a magnetic flux path for the magnetic flux generated by the coil;

a switch cover containing a pair of stationary contacts and a movable contact therein;

a cup-shaped frame having an open end for containing the magnetic core member therein and connecting the switch cover to the magnetic core member; and a plunger disposed in the magnetic core member for driving the movable contact to close or open the pair of the stationary contacts, wherein:

the magnetic core member includes a first core, a second core and a cylindrical yoke disposed between the first and the second cores;

the first core, the cylindrical yoke and the second core are all pressed together by a first axial force generated by peening a peripheral portion close to the open end of the cup-shaped frame;

wherein:

the cup-shaped frame includes a bottom wall and a cylindrical portion;

the cylindrical portion has a squeezed portion having an inner diameter a little smaller than an inner diameter of the cylindrical portion, the squeezed portion being connected to the bottom wall; and the first core is disc-shaped and is forcibly inserted in the squeezed portion.

2. The magnetic switch for a starter motor as in claim 1, wherein:

a depth of the squeezed portion is smaller than a thickness of the disc-shaped first core.

3. The magnetic switch for a starter motor as in claim 2, wherein:

a hollow space is formed between the disc-shaped first core and the cylindrical yoke; and an O-ring is disposed in the hollow space.

4. The magnetic switch for a starter motor as in claim 1, wherein:

the cylindrical portion of the cup-shaped frame further includes a holding portion formed at a position close to the open end; and the second core is forcibly inserted in the holding portion.

5. The magnetic switch for a starter motor as in claim 1, wherein:

the cylindrical yoke is formed by rounding a flat plate into a C-shaped body having a small gap, an outer diameter of the C-shaped body is a little larger than an inner diameter of the cup-shaped frame; and the C-shaped body is forcibly inserted into the cup-shaped frame by squeezing the small gap.

6. The magnetic switch as in claim 1, wherein:

the switch cover is connected to the magnetic core member by peening the open end of the cup-shaped frame and is pushed toward the magnetic core member by a second axial force generated by peening the open end of the cup-shaped frame, the second axial force being smaller than the first axial force.

* * * * *